United States Patent [19]

Rutschke

[11] 4,289,234

[45] Sep. 15, 1981

[54] CIGARETTE PACKAGE CLOSURE

[76] Inventor: Roger M. Rutschke, Laguna Beach, Calif.

[21] Appl. No.: 160,141

[22] Filed: Jun. 16, 1980

[51] Int. Cl.[3] ..... A25F 15/00; A25F 27/00; B65D 85/10; B65D 43/24

[52] U.S. Cl. ..... 206/259; 220/339

[58] Field of Search ..... 206/265, 259; 220/339, 220/335

[56] References Cited

U.S. PATENT DOCUMENTS

| | | | |
|---|---|---|---|
| 1,917,427 | 7/1933 | Brudney | 206/259 |
| 3,606,072 | 9/1971 | Pinchin | 220/335 |
| 4,144,985 | 3/1979 | Kinslow | 220/339 |
| 4,165,804 | 8/1979 | Georgopoulos | 206/259 |

*Primary Examiner*—William T. Dixson, Jr.
*Attorney, Agent, or Firm*—Gordon L. Peterson

[57] ABSTRACT

A cigarette package closure comprising a frame and a one-piece cover of self-hinging plastic material mounted on the frame. The cover includes a closure section, a lid and a hinge for joining the lid to the closure section for pivotal movement between a closed position and an open position. The inner surface of the cover has inner surface regions which are configured and arranged so that by urging such regions toward each other the lid is urged toward the open position. A spring confronts the inner surface of the cover and urges the surface regions toward each other to thereby bias the lid toward the open position. A latch mechanism on the frame and the lid releasably holds the lid in the closed position.

10 Claims, 5 Drawing Figures

Fig. 1
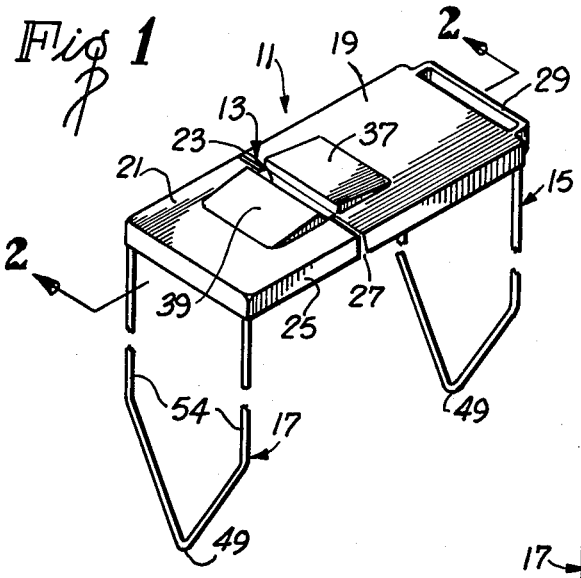
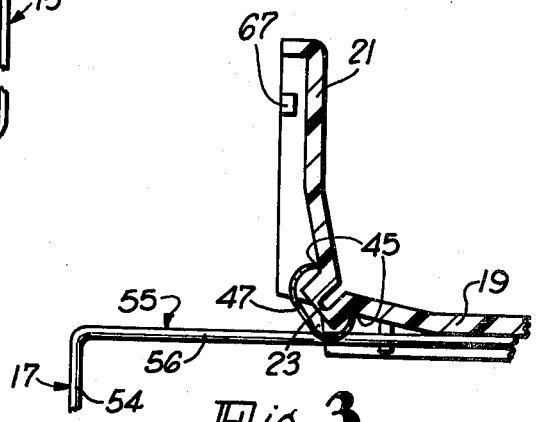
Fig. 3
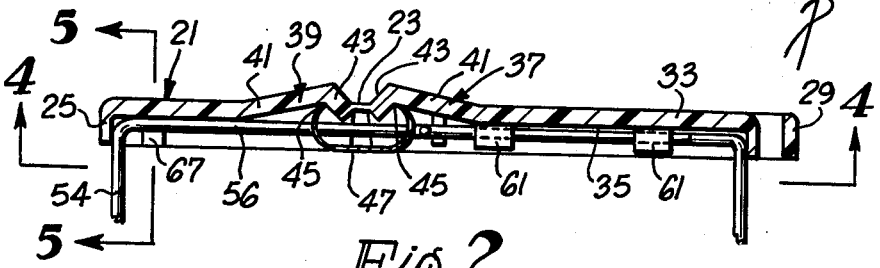
Fig. 2
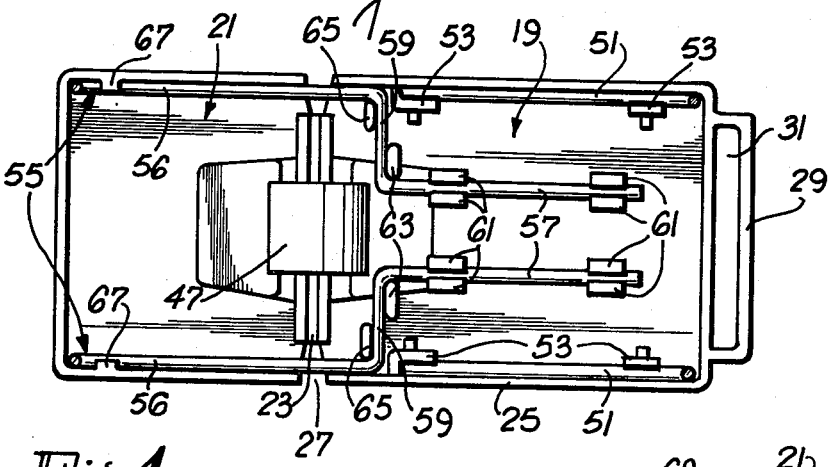
Fig. 4
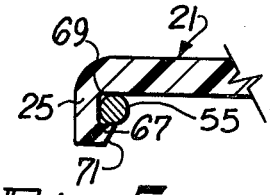
Fig. 5

CIGARETTE PACKAGE CLOSURE

BACKGROUND OF THE INVENTION

This invention relates to a cigarette package closure for selectively closing one end of a cigarette package. Closures of this type may include a frame and a cover attached to the frame. The frame is insertable into, or otherwise installed on, the cigarette package to mount the closure on the cigarette package. The cover may include a closure section, a lid and a hinge for hingedly joining the lid to the closure section for movement of the lid between open and closed positions.

Cigarette package closures of this type have many advantages. For example, the frame protects the package against crushing and the cover positively prevents cigarettes or tabacco from falling out of the package. The cover closes the top of the package to keep the cigarettes fresher and the lid is openable to allow each removal of cigarettes.

Typical prior art cigarette pack closures are shown, by way of example, in Chambers U.S. Pat. No. 3,743,136, Georgopoulos U.S. Pat. No. 4,165,804, Williams U.S. Pat. No. 2,859,865, and Gray U.S. Pat. No. 3,298,590. The Chambers and Georgopoulos devices are relatively complex and require a multiple piece cover, a pin-type hinge, and a separate coil-like spring. The device of the Gray patent is of simpler construction, but it constitutes an entire cigarette box and the operation of the Williams device is subject to the placement of axial crushing forces on the cigarettes in the package.

SUMMARY OF THE INVENTION

This invention provides a cigarette package closure which generally overcomes these and other disadvantages of the prior art. The cigarette package closure of this invention generally includes frame means insertable into the cigarette package for installing the closure on the package and a cover attached to the frame for covering and end of the package.

Construction of the cigarette pack closure of this invention is simplified by utilizing a one-piece cover of self-hinging plastic material. The cover includes a closure section, a lid and a hinge for joining the lid to the closure section for pivotal movement. The hinge is constructed of the self-hinging plastic material of the cover and so is formed integrally with the cover. The lid can be pivoted between a closed position in which the lid assists in closing the end of the cigarette package and an open position in which the lid exposes a portion of the end of the cigarette package.

The lid is biased toward the open position by a spring of simple construction. In addition, the spring is on the inner surface of the cover and is not visible when the lid is in the closed position. Accordingly, the appearance of the closure is greatly improved. This can be accomplished, for example, by configuring and positioning inner surface regions of the cover so that by urging these regions in a predetermined direction relative to each other, the lid is urged toward the open position. The spring acts against these inner surface regions in such predetermined direction to thereby resiliently urge the lid toward the open position. In a preferred construction, these inner surface regions are on opposite sides of the hinge and lie outwardly of the hinge.

With this construciton, the spring can advantageously be in the form of a generally C-shaped clip which grips the inner surface regions and tends to move them toward each other. The opposite ends of the clip dig into the inner surface regions sufficiently to mount the clip on the inner surface of the cover. In a preferred construction, the cover is constructed of sheet material and includes hollow projections on opposite sides of the hinge with the inner surface regions forming portions of these projections and with the spring being at least partially received within the projections.

Releasable latch means which is at least partially on the lid is provided for releasably retaining the lid in the closed position. Preferably the latch means includes a latch on the inner surface of the lid and a portion of the frame.

The frame includes first and second separate wire-like members mounted on the closure section. One of the wire-like members cooperates with the lid to latch the lid in the closed position. The two-pieces wire construction gives a better spring action to the wire-like member which cooperates with the lid. In addition, the two-piece wire construction is believed to wear much slower and require less support on the cover than would be required for a one-piece wire frame.

One of the second wire-like members may include first and second legs joined together to form a loop with first portions of such legs extending along the inner surface of the lid in spaced apart relationship and sections which extend toward each other along the closure section adjacent to the lid. Lugs are provided on the inner surface of the closure section for engaging such sections of the wire-like member. Each of the wire-like members may terminate in end portions with the end portions of the second wire-like member being attached to the closure section intermediate the end portions of the first wire-like member. This forms a strong composite structure and mounts the second wire-like member for good spring action in a way to promote a longer useful life of the closure.

The invention, together with further features and advantages thereof, may best be understood by reference to the following description taken in connection with the accompanying illustrative drawing.

BRIEF DESCRIPTION OF THE DRAWING

FIG. 1 is an isometric view with parts broken away of a cigarette package closure constructed in accordance with the teachings of this invention.

FIG. 2 is a sectional view taken generally along line 2—2 of FIG. 1.

FIG. 3 is a fragmentary sectional view similar to FIG. 2 with the lid in the open position.

FIG. 4 is a bottom plan view taken generally along line 4—4 of FIG. 2.

FIG. 5 is a fragmentary sectional view taken generally along line 5—5 of FIG. 2.

DESCRIPTION OF THE PREFERRED EMBODIMENT

Figure 6:
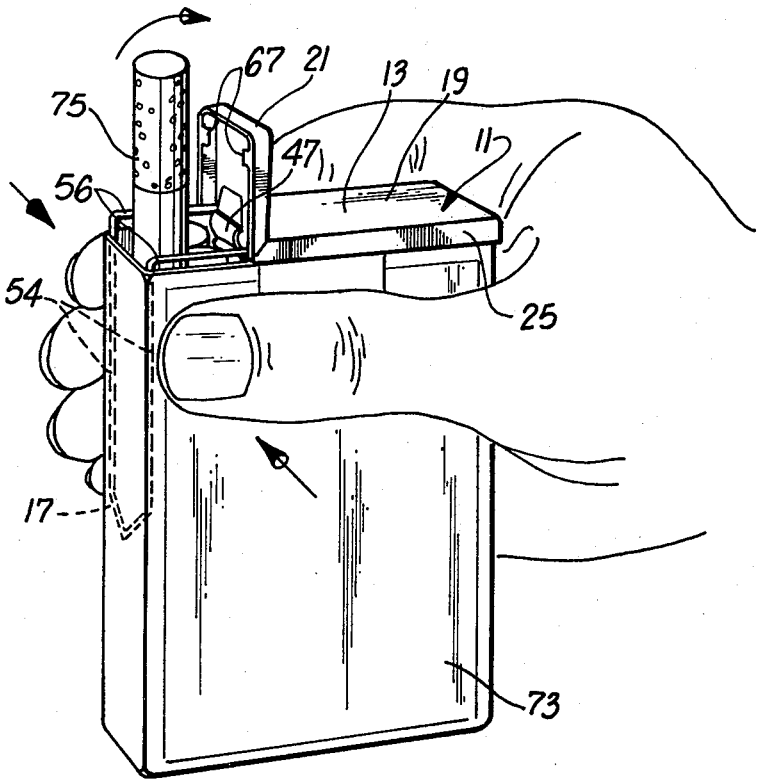
FIG. 6 is an isometric view illustrating the operation of the closure.

FIG. 1 shows a cigarette package closure 11 which generally includes a cover 13 and frame members 15 and 17 which cooperate to define a frame for the closure. The cover 13 includes a closure section 19, a lid 21, and a hinge 23 integrally joining the lid to the closure section for pivotal movement between a closed position shown in FIGS. 1, 2 and 4 and an open position shown in FIGS. 3 and 6. The cover 13 is preferably integrally molded from suitable self-hinging plastic material such as polypropylene. With this construction, the hinge 23 is defined by a relatively thin section of the self-hinging plastic material. The cover 13 is of sheet material and has a peripheral flange 25 which is interrupted by gaps 27 at the opposite ends of the hinge 23.

The closure section 19 in the embodiment illustrated forms a major portion of the cover 13 and includes a bar 29 integral with the closure section 19 at the end remote from the lid 21. The bar 29 is spaced from the flange 25 to define a slot 31 to permit the bar 29 to be used as an attachment for matches, a cigarette lighter, or other device.

The cover 13 has an outer surface 33 and an inner surface 35. The closure section 19 and lid 21 have projections 37 and 39, respectively, which project upwardly above the plane of the cover 13. The projections 37 and 39 are hollow with portions of the inner surface 35 defining the hollow regions of the projections. In the embodiment illustrated, the cover 13 is of substantially uniform thickness except for the hinge 23 and the flange 25, which are thinner. The projections 37 and 39 are formed by molding regions of the cover outwardly as shown in FIG. 2.

More specifically, each of the projections 37 and 39 is formed by two sloping sections 41 and 43 with the sloping sections 41 extending upwardly and outwardly and the sloping sections 43 extending from the adjacent ends of the sloping sections 41 inwardly and downwardly. The hinge 23 integrally joins the sloping sections 43 at their adjacent edges. This provides the inner surface 35 with a shoulder or inner surface region 45 at the inner junction of each of the sloping sections 41 and 43. The inner surface regions 45 are positioned on opposite sides of the hinge 23 and outwardly of the hinge 23 so that by squeezing the regions 45 toward each other, the lid 21 is biased toward the open position of FIG. 3.

To accomplish the biasing function, a spring 47 in the form of a generally C-shaped clip is provided with the opposite ends of the spring bearing against the regions 45, respectively. This gripping engagement of the spring 47 on the regions 45 biases the lid 21 toward the open position and mounts the spring on the cover 13. The ends of the clip may dig into the regions 45 to assist the mounting of the clip of the cover 13.

Although the frame members 15 and 17 can be of various different constructions, in the embodiment illustrated, each of them is a wire-like member of metal or other suitable material formed into an open loop with the closed end of the loop forming a generally V-shaped leading edge 49 as shown in FIG. 1. The frame member 15 terminates in parallel end portions 51 (FIG. 4) which extend along the opposite longitudinal edges of the closure section 19 adjacent to the flange 25. The end portions 51 are held agains the opposed regions of the flange 25 by lugs 53 molded integrally with the closure section 19.

The frame member 17 includes parallel legs 55 first portions 56 of which extend along the opposite edges of the lid 21 for the full length of the lid adjacent the flange 25 and for a short distance along the flange 25 on the closure section 19. Second portions 54 of the legs 55 project downwardly to the leading edge 49. The frame member 17 has parallel end portions 57 integrally joined to the legs 55, respectively, by inwardly extending sections 59 which, in the embodiment illustrated, are perpendicular to the legs 55 and the end portions 57. The end portions 57 are mounted between the end portions 51 by lugs 61 molded integrally on the inner surface 35. In the embodiment illustrated, two sets of the lugs 61 are provided for each of the end portions 57.

The sections 59 are retained by lugs 63 and 65 located respectively, at junctures of the end portions 57 and the sections 59 and of the legs 55 and the sections 59.

The lid 21 has a pair of latch members 67 which project inwardly from spaced opposed regions of the flange 25 along the opposite longitudinal edges of the lid. Each of the latch members 67 cooperates with a region of the flange 25 and a portion of the lid 21 to define a notch 69 (FIG. 5) for receiving one of the legs 55. Each of the latch members 67 has an inclined end face 71.

With the legs 55 received in the notches 69, the lid 21 is held in the closed position. However, the legs 55 are unrestrained by the lid 21 against resilient movement toward each other. Accordingly, by squeezing the legs 55 toward each other, the legs can be moved out of the notches 69 to free the lid 21 for movement to the open position under the biasing force of the spring 47. The lid 21 can be closed manually by pivoting it toward the closed position until the latch members 67 snap over the legs 55 with such snap action being facilitated by the inclined end faces 71. The mounting of the sections 59 and the end portions 57 provide the legs 55 with a relatively long length to accommodate the slight inward movement necessary to move them out of the notches 69, and, accordingly, the stresses on the legs 55 and on the lugs 61,, 63 and 65 are minimal.

FIG. 6 shows how the closure 11 can be used with a soft cigarette package 73. A portion of the upper end of the package 73 is torn off and the frame members 15 and 17 are inserted inside the package. The frame members 15 and 17 mount the closure 11 on the cigarette package 73 and they rigidify and strengthen the soft package 73 to protect cigarettes 75 within the package.

By squeezing portions 54 of the legs toward each other, the legs 55 are resiliently moved inwardly to release the latch members 67 and the lid 21 so that the spring 47 can move the lid to the open position. This opens the closure 11 so that cigarettes can be removed from the package. The lid 21 can be closed as described above. The cover 13 is sized so that it fits over the entire upper end of the package 73 with the flange 25 extending around the perifphery of the upper end of the package.

Although an exemplary embodiment of the invention has been shown and described, many changes, modifications and substitutions may be made by one having ordinary skill in the art without necessarily departing from the spirit and scope of this invention.

I claim:

1. A cigarette package closure for selectively closing one end of a cigarette package comprising:

frame means insertable into the cigarette package for installing the closure on the package;

a one-piece cover of self hinging plastic material for covering the end of the cigarette package;

means for mounting the cover on the frame means;

said cover including a closure section, a lid and hinge means of said self-hinging plastic material for hingedly joining the lid to the closure section for pivotable movement between a closed position in which the lid assists in closing the end of the cigarette package when the closure is installed on the cigarette package and an open position in which the lid exposes a portion of the end of the cigarette package when the closure is installed on the cigarette package;

said cover having an outer surface and an inner surface, said inner surface having first and second inner surface regions located so that by urging such inner surface regions in a predetermined direction relative to each other, the lid is urged toward the open position;

spring means confronting the inner surface for urging the inner surface regions in said predetermined direction whereby the lid is biased toward the open position; and releasable latch means at least partially on the lid for releasably retaining the lid in the closed position.

2. A cigarette package closure as defined in claim 1 wherein said spring includes a generally C-shaped clip having ends which forcibly engage said inner surface regions sufficiently to mount the clip on the inner surface of the cover.

3. A cigarette package closure as defined in claim 1, wherein said inner surface regions are on opposite sides of the hinge means and lie outwardly of the hinge means and said spring means urges the inner surface regions toward each other.

4. A cigarette package closure as defined in claim 3, wherein said cover is constructed of sheet material and includes hollow projections on opposite sides of the hinge means with such projections extending outwardly of the closure, said inner surface regions forming at least portions of said projections, said spring means being at least partially received within said projections.

5. A cigarette package closure as defined in claim 1, wherein said frame means includes first and second separate wire-like members, said mounting means includes means on the closure section for attaching the cover to both of the wire-like members.

6. A cigarette package closure for selectively closing one end of a cigarette package comprising:

frame means insertable into the cigarette package for installing the closure on the package and for strengthening the package;

a cover for covering the end of the cigarette package;

means for mounting the cover on the frame means;

said cover including a closure section, a lid and hinge means for hingedly joining the lid to the closure section for pivotal movement between a closed position in which the lid assists in closing the end of the cigarette package when the closure is installed on the cigarette package and an open position in which the lid exposes a portion of the end of the cigarette package when the closure is installed on the cigarette package said cover having an outer surface and an inner surface;

a spring means for biasing the lid toward the open position;

said frame means including first and second separate wire-like members;

said mounting means includes means on the inner surface of the closure section for attaching the first wire-like member to the closure section;

said second wire-like member including first and second legs joined together to form a loop, first portions of said legs extending along the inner surface of the lid in spaced relationship and segments of said legs extending along the inner surface of the closure section, said segments being joined to said first portions, respectively, by bend sections;

said mounting means including means on the inner surface of the closure section for attaching the segments of the second wire-like member to the closure section, the first portions of said legs extending along the inner surface of the lid being resiliently movable toward each other; and a latch on said lid cooperable with at least one of said legs for retaining the lid in the closed position against the biasing force of the spring means whereby movement of the legs toward each other releases the latch and the lid to allow the spring means to move the lid toward the open position.

7. A cigarette package closure as defined in claim 6 wherein said segments include sections adjacent said first portions of the legs that extend toward each other along the closure section, and said mounting means includes lugs for engaging said sections of said segments.

8. A cigarette package closure as defined in claim 7 wherein said segments include has end portions coupled to said sections of the segments with the end portions extending along the closure section and said mounting means includes lugs on the inner surface of the closure section engaging said end portions.

9. A cigarette package closure as defined in claim 6 wherein said first wire-like member includes at least two end portions and said segments include at least two end portions, all of said end portions lying along said closure section, said end portions of said second wire-like member lying inwardly of the end portions of the first wire-like member, and said mounting means includes a plurality of lugs on the inner surface of the closure section for engaging said end portions.

10. A cigarette package closure as defined in claim 6 wherein said cover is of one-piece construction, said spring means includes a generally C-shaped clip mounted on the inner surface of the cover, said cover is constructed of sheet material and includes hollow projections on opposite sides of the hinge means with such projections extending outwardly of the closure, and said C-shaped clip being at least partially received within said projections.

* * * * *